United States Patent [19]

McKay

[11] Patent Number: 4,640,420

[45] Date of Patent: Feb. 3, 1987

[54] GARMENT LOCK

[76] Inventor: Scott A. McKay, 13811 Bessemer St., Van Nuys, Calif. 91401

[21] Appl. No.: 543,750

[22] Filed: Oct. 20, 1983

[51] Int. Cl.[4] ..... A47F 7/19

[52] U.S. Cl. ..... 211/4; 70/59; 211/8

[58] Field of Search ..... 24/4, 7, 8, 124; 70/59, 70/58, 57, 62

[56] References Cited

U.S. PATENT DOCUMENTS

| | | | |
|---|---|---|---|
| 603,544 | 5/1898 | Wagenblast | 211/4 X |
| 610,372 | 9/1898 | Sanford | 211/4 |
| 3,543,941 | 12/1970 | Gorman | 211/4 |
| 4,088,228 | 5/1978 | Schwalbe | 211/4 |
| 4,260,063 | 4/1981 | Bennett et al. | 70/59 X |
| 4,300,690 | 11/1981 | Thomas | 70/59 X |
| 4,336,885 | 6/1982 | Thomas | 70/59 X |
| 4,336,886 | 6/1982 | Azoulay et al. | 211/13 |

*Primary Examiner*—Robert W. Gibson, Jr.
*Attorney, Agent, or Firm*—Richard D. Slehofer

[57] ABSTRACT

A clothing rack for retaining an article of clothing so that it cannot be removed by a shoplifter.

There is a frame with a brace bar at the lower end of the frame and a locking channel section at the upper end of the frame. A securing rod or hanger is permanently attached at one end of the brace. The other end of the rod or hanger has an extension for locking into the channel section. The channel section includes a cover which, when closed, has a bar to prevent the hanger extension from disengaging from the channel section. A clerk can unlock the cover to release the upper end of the hanger so that an article of clothing can be removed to be fitted by a customer and thereafter replaced by running the rod through one leg of a pair of trousers or the sleeve of a coat or jacket and relocking it to the clothing rack.

20 Claims, 13 Drawing Figures

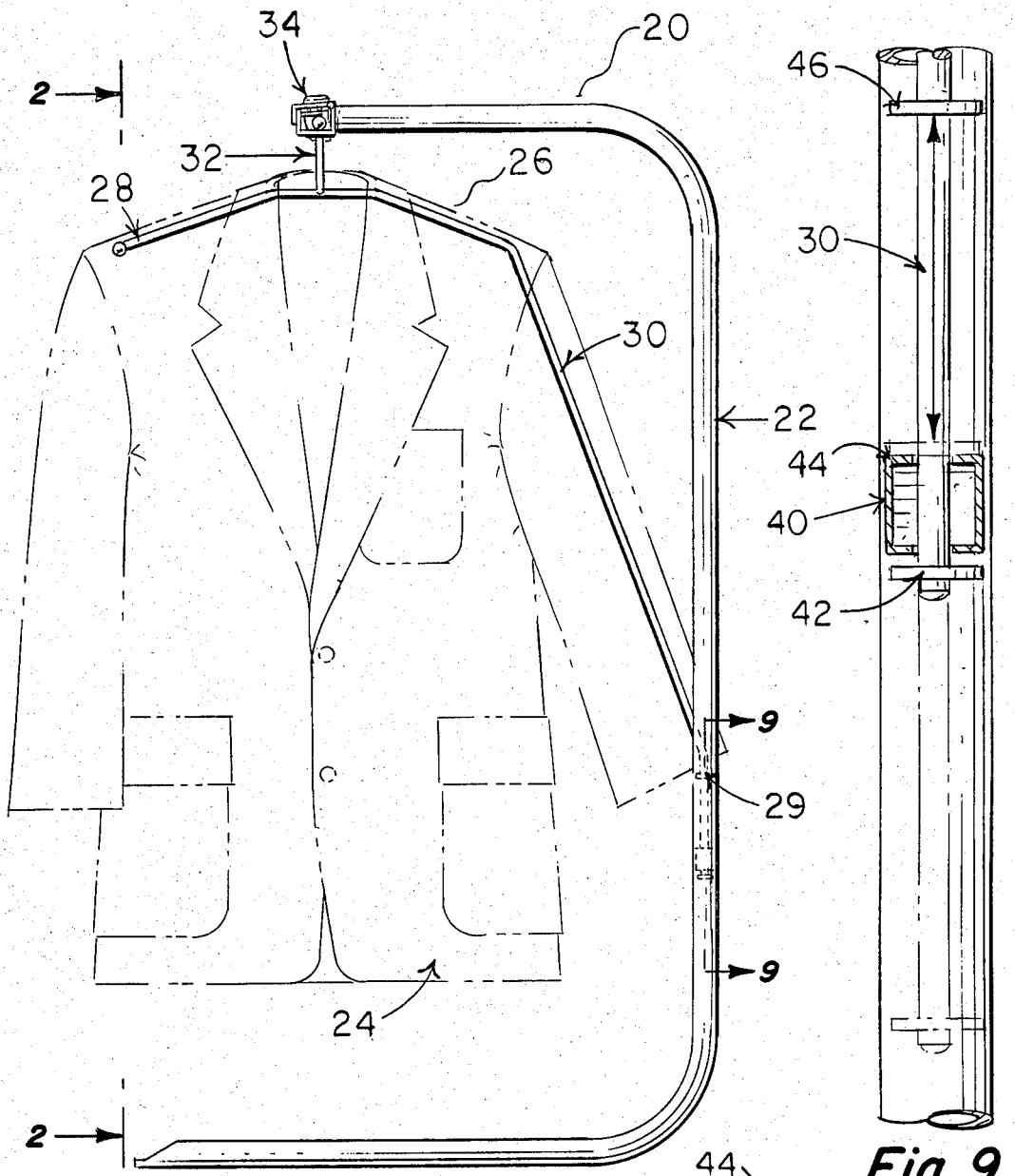
Fig. 1.
Fig. 9.
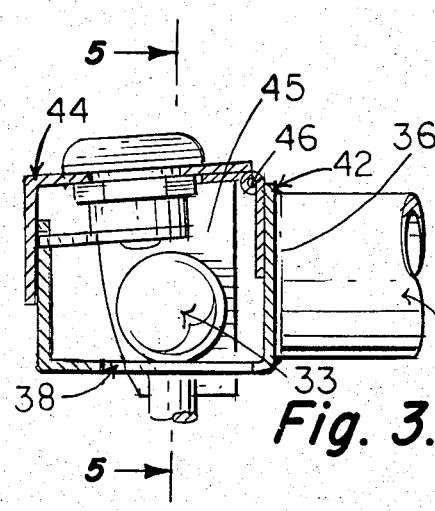
Fig. 3.
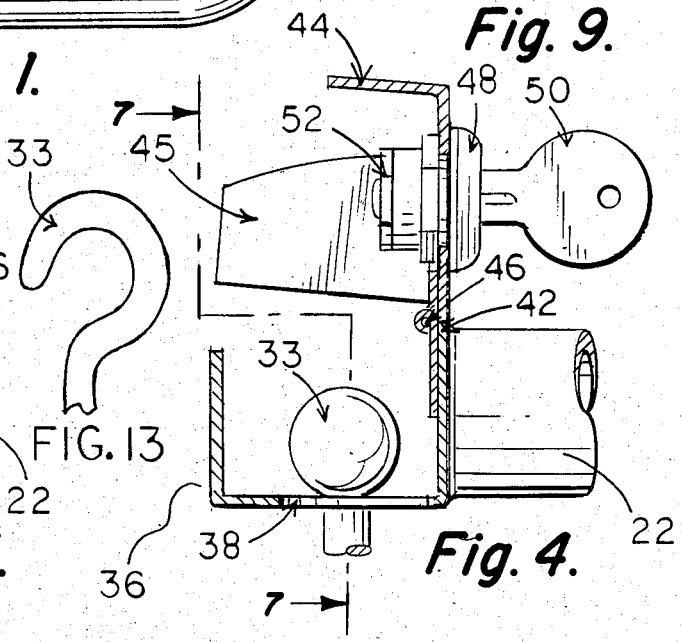
FIG. 13
Fig. 4.

GARMENT LOCK

BACKGROUND OF THE INVENTION

Security racks for safely preventing theft of clothing are known in the art. The typical way of securing an article of clothing is by using a hanger which is secured at one end to a lock and is free standing. The hanger is removed from its base and threaded through one sleeve of an article of clothing. The shoulder area of the hanger contains a flared projection so that the sleeve cannot be slipped over this wide projection. The other end, the supporting means of the hanger, is secured by a lock so that the hanger itself cannot be removed.

Other security devices include chains or flexible steel cables which can be attached at both ends to a locked base. One end is attached to the base and then it is threaded through a sleeve or other part of the article of clothing. The other end is also attached to the base. The disadvantages in this prior art is that the flexible steel cable does not act as a hanger support for the article of clothing. Accordingly, in addition to the securing cable, one must have a hanger for supporting the article of clothing. The cable must be passed through a sleeve in order to secure it, and whenever the article of clothing is temporarily removed, the cable must be re-threaded to re-secure the article of clothing. This is time consuming.

In the pre-standing rigid hangers, the lock means is only at one end of the hanger and the base of the hanger could be cut or pulled out thereby allowing the sleeve of the garment to be slipped off the hanger. With the increasing reliance of selfservice retailing establishments with a minimum of sales clerks, it became apparent to retailers that anti-theft devices must be attached to their expensive items in order to prevent the shoplifting of them. Shoplifting has become an increasingly expensive overhead which many retailers are unable to or no longer able to tolerate. Therefore the need was apparent that there should be a security garment rack which is theft proof, easy to manufacture, easy to operate and to visually deter any shoplifters from even attempting to vandalize the machine or the rack and shoplifting the article of clothing, or disabling the clothing rack.

SUMMARY OF THE INVENTION

Accordingly, it is the object of this invention to provide a strong theft-proof security garment rack which can be either self standing or fabricated into various wall dividers of a retail establishment. It is easy to manufacture, very durable, almost impossible to damage and acts as a visual deterrent to criminals. It also provides 2 securing means, one at the base and one at the nape of the hanger to make it nearly impossible to vandalize the security garment.

It is another objection to this invention to provide for a single security rack which may find use in places such as bus depots, restaurants or the like where each individual security consists of one hanger.

It is a further object of this invention to provide for a security rack which can be run through one leg of a pair of trousers, thereby preventing the trousers from being removed unless the security rack is unlocked.

It is the further object of this invention to provide for a security rack which contains a plurality of hangers spaced sufficiently far apart to allow a side by side display of garments for inspection by the potential customers in a retail establishment. The locking means of each section of the security garment could unlock say 20 garments at once to allow a sales clerk to unlock by section in response to a customer's request to try on a particular garment, and thereafter be locked during the fitting phase, and unlocked and the garment re-secured to the security lock should a customer choose not to purchase the garment. It is intended that the sections of security hangers could be endless rows upon rows in a clothing store because each clothing rack can be considered to be a repeatable section of a lock means, a hanger means and a brace means. These units can be manufactured or fabricated as repeating units for installation in a variety of places or they can be fabricated as free standing units which can be bolted to the floor and containing a plurality of hangers close enough so that a variety of any given size or style of clothing could be all grouped on one particular security rack having one particular unlocking key for that section.

BRIEF DESCRIPTION OF THE DRAWINGS

FIG. 1 is a side elevational view of the coat rack showing a coat hanger hanging a lapel jacket indicated in phantom lines.

FIG. 3 is a side fragmentary view of the channel section showing the hinged cover closed and locked.

FIG. 4 is FIG. 3 with the hinge cover opened and indicating that the locking means is unlocked.

FIG. 6 is taken along lines of 6—6 of FIG. 5.

FIG. 9 is a side-sectional fragmentary view showing how the one end of the hanger is attached to the brace and indicating a limited amount of reciprocal movement.

FIG. 13 is an elevational view of another embodiment of enlargement attached to the upright member.

DETAILED DESCRIPTION OF A PREFERRED EMBODIMENT

Figure 2:
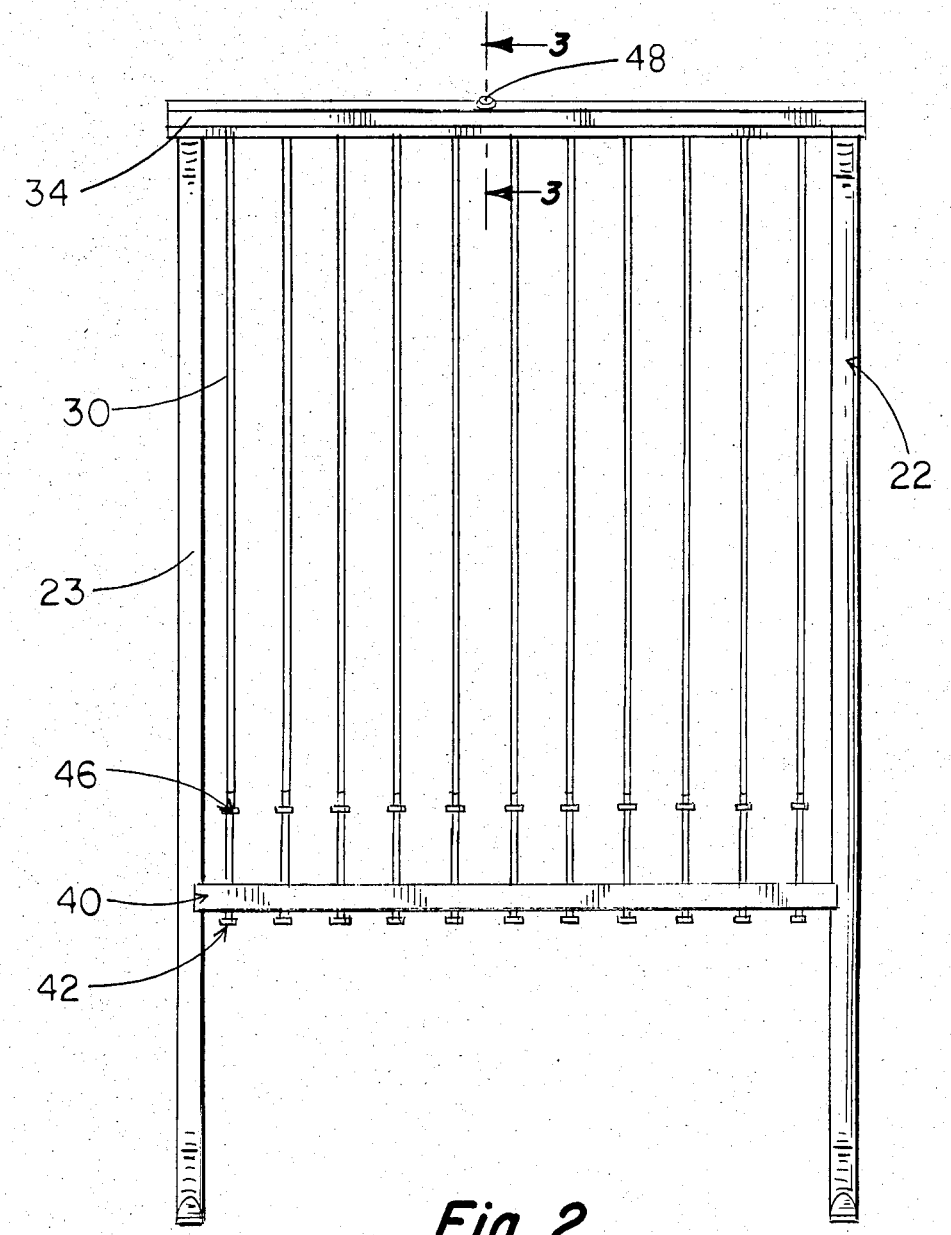
FIG. 2 is a front elevational view of the coat rack depicted in FIG. 1

Referring now to FIG. 1 there is disclosed a side elevational view and a free standing security clothing rack generally designated as 20. There is a first upright arm generally designated as 22. There is a men's sports coat shown in phantom lines which indicates the general orientation by which these various pieces of clothing will be secured to the rack. The coat is generally referred to as 24. There is also disclosed in FIG. 1 a hanger generally referred as 26. The hanger 26 is further divided into a generally horizontal section 28, a downwardly extending vertical extension 30 attached at the end of the horizontal section 28. An upright section 32 is attached mid-way between the ends of the horizontal section 28 of the hanger 26. The horizontal section 32 is engaged with what is generally described as locking means 34. The locking means 34 will be described in greater detail in succeeding paragraphs. The terminal end of the downward extending section 30 is secured as indicated in section lines in FIG. 1 and it is attached to a brace generally designated as 40. The upright arm 22 would be considered part of the framing means of the clothing garment. FIG. 2 shows a front elevational view of FIG. 1 showing the first upright arm 22 and the second upright arm 23. The brace 40 is shown extending between the first upright arm 22 and the second upright arm 23. This brace is preferably welded at each of its ends to firmly hold both upright arms 22 and 23. The locking means 34 is also disclosed which is attached near the tips of the upright arm 22 and 23. The locking means 34 is attached to both arms as the brace means 40 is. The brace 40 and the locking means 34 provide rigidity and strength to the frame means upon which the hangers 26 are secured. The locking means 34 is further described as a channel section 36 which has a web or base 38 and a edge 42. The channel section 36 has attached to it at its edge 42 a hinged cover 44. The hinged cover 44 is attached at the edge 42 by means of a hinge 46 which results in a limited pivotal movement between the hinged cover 44 and the edge 42 of the channel section 38. FIG. 4 discloses a cross sectional view of this channel section disclosing the hinged cover in an unlocked or open position. Fig. 3 also indicates the channel section 36 where the hinged cover 44 is in a closed or locked position. FIG. 3 indicates how the end upright arm 22 is attached to the channel section 36. This can be any type of a connection, but preferably a weld connection would be the strongest.

Referring back now to the hanger generally designated as 26, the hanger is secured to the brace 40 at its lower projection 30. It can be secured by being welded directly to the base however this would prevent any kind of a limited reciprocal up and down movement of the vertical projection 30. It has been found that it is much more efficient for a clerk to be allowed to install and remove the article of clothing 24 by allowing the hanger 26 to some downward movement relative to the upright frame 22. Accordingly, there is disclosed in FIG. 9 the means to accomplish this result. The downwardly extending section 30 is shown as having a limited reciprocal movement relative to the brace 40. There is a first stay means 42 attached to the end of the hanger 30 which will prevent the hanger from being separated from the brace 40. This first stay means 42 can be any kind of a projection which will prevent the end of the hanger 30 from sliding through the hole 44 in the brace 40. This first stay means 42 can be a circular washer, a ball or the like which can be secured to the end of the hanger section 30. This is most easily accomplished by providing a heavy washer slipped over the end of hanger 30 and welded in place. The reciprocal movement can be limited by the downwardly extending projection 30. The reciprocal movement of the projection 30 can be limited in various ways by having a second stay means 46 secured to the downwardly extending projection of the hanger 30 as indicated in FIG. 9. This second stay means could be identical to the first stay means 42 such as a circular washer which can be welded at a particular location on 30. This will allow a limited downwardly up and down movement of the hanger 26. The hanger 26 is of a sufficiently rigid construction preferably fabricated from a 5/16 inch rolled steel roll. The limited reciprocal movement between stay 42 and stay 46 allows the hanger to drop overall 2 to 3 inches. This convenience allows the clerk to unslip the one sleeve of the garment 24 past the upright section 32 and off the entire hanger 26. This rigidity and clearance allows the clerk to reverse this procedure quite easily by using both hands to slip one of the sleeves of the garment back over the horizontal section 28 of the hanger, past the upright section 32 and down over the downwardly extension projection 30. Then the clerk simply lifts up on the hanger at the intersection of the upright section 32 and the horizontal section 28 and re-engages the upright section with the channel section 34. It is allowable that instead of having a reciprocal movement between the first stay 42 and the second stay 46, the downwardly extending projection 30 could simply be welded at the brace 40. The hanger thus could be bendable or resilient to be able to be pulled out away from the channel section 34 to allow the garment to be removed and slipped on the hanger. This is one embodiment contemplated by the inventor. It would be more economical to fabricate a clothing in this manner. However, the entire hanger would have to be sufficiently resilient to allow the sales clerk to bend the hanger downwardly from the locking means to remove and return the garment to the hanger.

In the rigid hanger embodiment, the hanger is fabricated from 5/16 inch rolled steel. This material is nearly unbendable, but it is extremely resistant to being cut by a hack saw or being severed with a pair of wire cutters. A more bendable hanger will of necessity comprise the theft prevention aspect of the rigid hanger.

Figure 5:
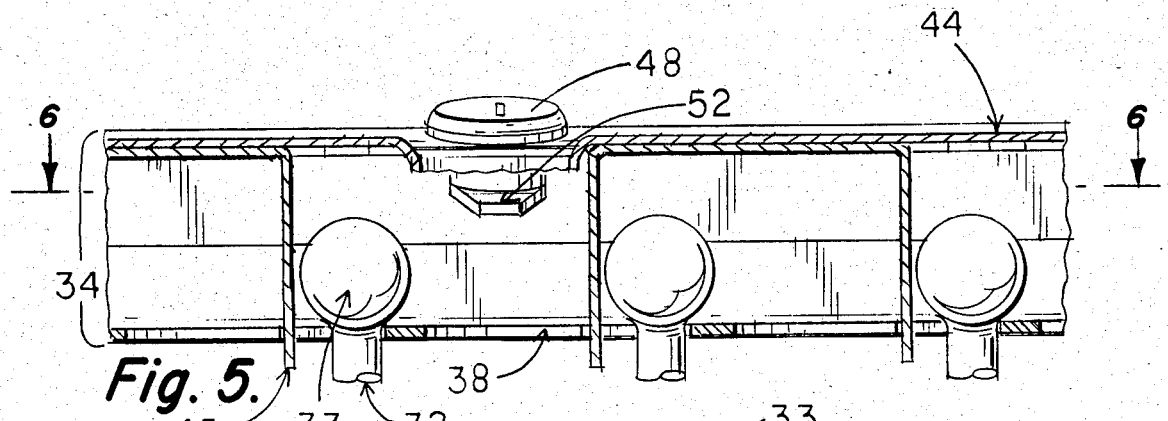
FIG. 5 is a front sectional view of the channel section with the hinge cover locked.
Figure 6:
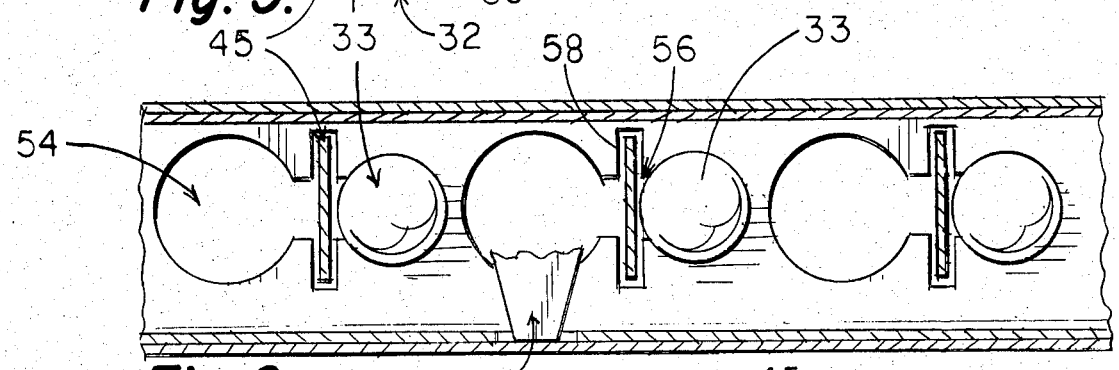
FIG. 6 is a top sectional view with the hinge cover removed indicating the rod extension in place and locked and a fragmentary view of the cam in place and locked.

FIGS. 3 and 5 show the locking means locked from a front-sectional and side-sectional view respectively. These Figs. also show a cylinder lock 48, a key 50 and a cam means 52 attached to the lock 48 such that when the key 50 is turned, the cam 52 pivots and secures its end in the channel section 36 thereby preventing the hinged cover 44 from opening without unlocking the lock 48.

The upright section 32 extending from the hanger 26 has an enlargement 33 at the end not attached to the hanger 26. This enlargement is disclosed as a ball in the Figs. However, it is contemplated by the inventor that the enlargement could be other configurations. For example, it could be a hook, as disclosed in FIG. 13; a knob; a washer; or a button. The only limitation on the enlargement 33 is that its overall diameter be small enough to pass through the larger end of the tapered opening 54.

Figure 11:
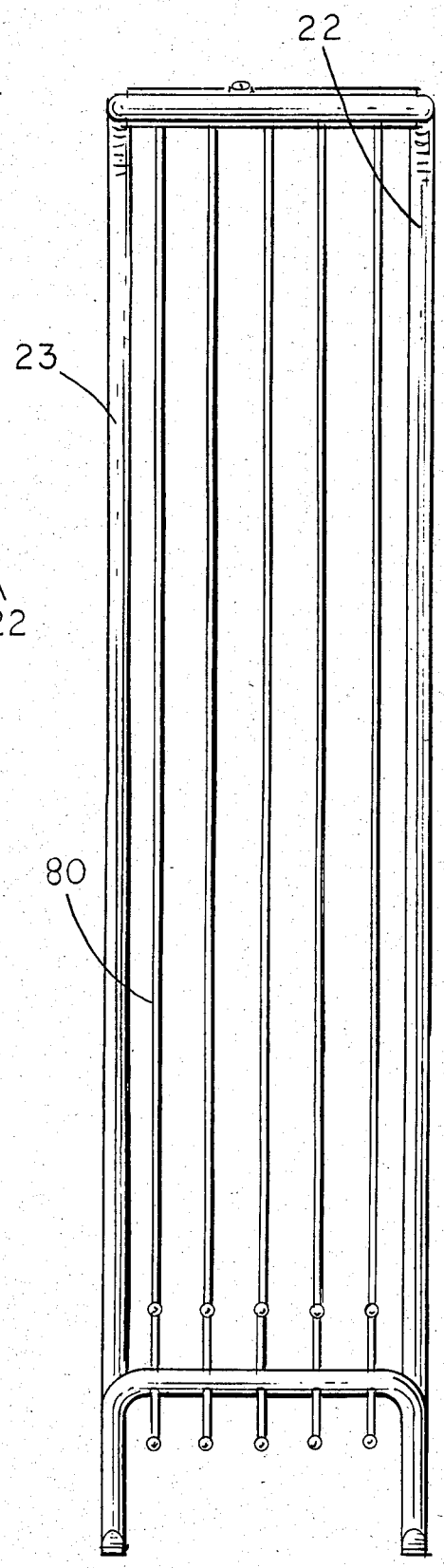
FIG. 11 is the front elevational view of FIG. 10 taken along the lines 11.

The tapered opening 54 is disclosed in all of the Figs. as a key-hole shaped slot having a smaller opening or slot 56. The overall width of the upright section or hanger extension 32 must be small enough to allow a slideable fit in the slot 56. The key-hold shaped slot 54 is punched out of the web of the channel section 36. In embodiments disclosed in FIG. 2 and FIG. 11, the slots 54 are punched out of the web or base 38 in a spaced and repeating fashion to allow for the support of a plurality of hangers 26 (FIG. 2) or rods 80 (FIG. 11).

The key-hole shape for the opening 54 is disclosed because it is easy to fabricate, or punch out from the channel section. A transverse slit is disclosed at 58. The purpose of this slit 58 is to hold the stop means 45 to provide strength whenever the hinged cover 44 is closed by preventing a shoplifter from sliding the enlargement 33 from the slot 56 and pulling the head or enlargement 33 through the large opening 54. This would allow the hanger 26 or rod 80 to be separated from the locking means 34, thereby allowing the removal of the article of clothing secured by the rod or hanger.

Figure 7:
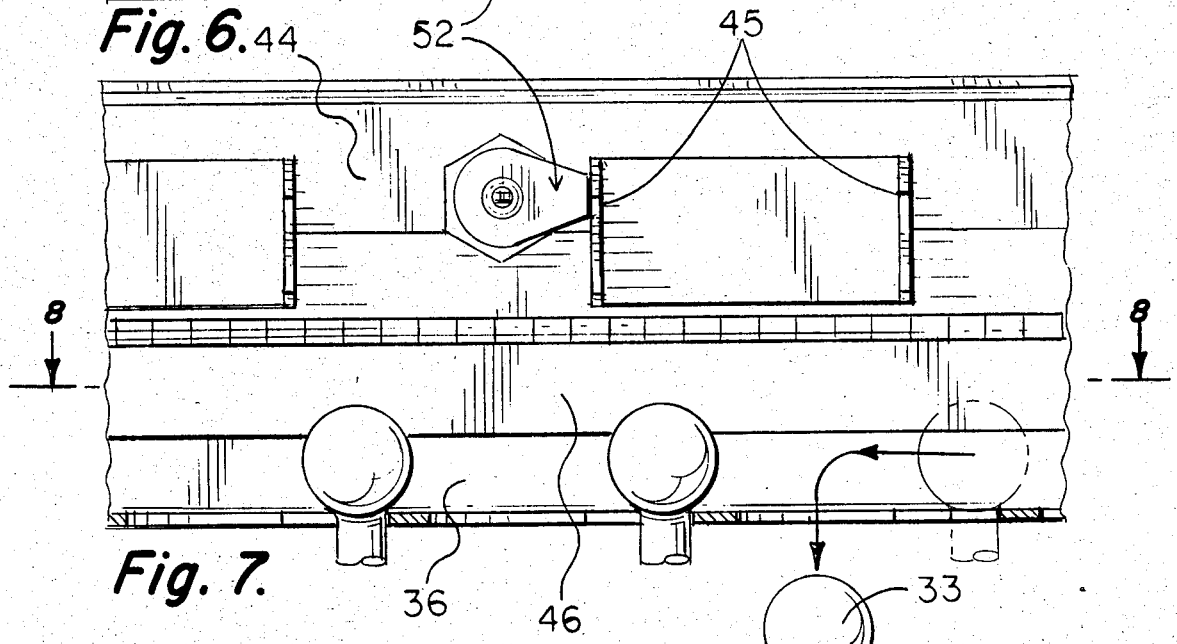
FIG. 7 is a fragmentary sectional view of the channel section with the hinged cover open.
Figure 8:
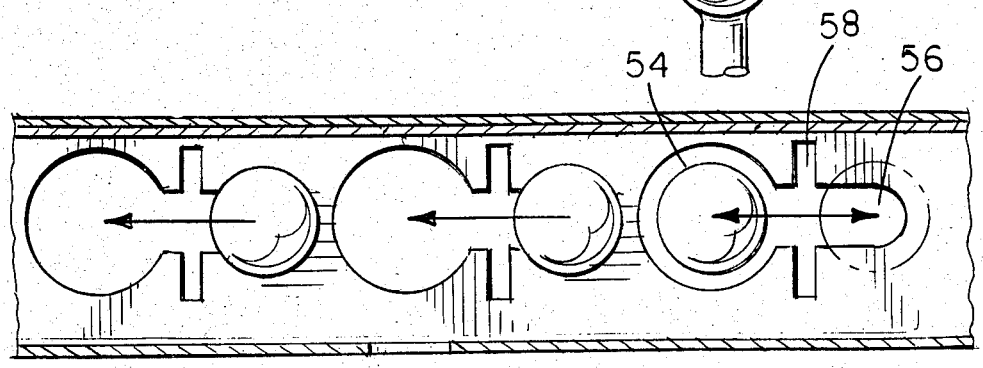
FIG. 8 is a top fragmentary sectional view taken along the lines 8—8 and FIG. 7 indicating the enlargements in the appropriate slots.

FIGS. 7 and 8 disclose how the ball 33 is secured in the locking means 34. The upright section 32 is simply lifted up and through the opening 54, then moved horizontally into the slot portion 56 of the opening 54. The removal is the reversal of the aforesaid steps.

Referring back now to the stop means 45 shown in the various Figs. The stop means can be further described as a bar attached to the underside of the hinged cover 44. The bar 45 is positioned such that whenever the enlargement 33 is in locked position in the slot 56, bar 45 will be adjacent to the head 33 whenever the cover 44 is closed. The bar will prevent the head from being slid horizontally and separating the hanger from the channel section 36. In the preferred embodiment, the end of the bar 45 will pass through the transverse slit 58 whenever the cover 44 is closed. This combination creates nearly a theft-proof connection after the cover 44 is locked.

Figure 12:
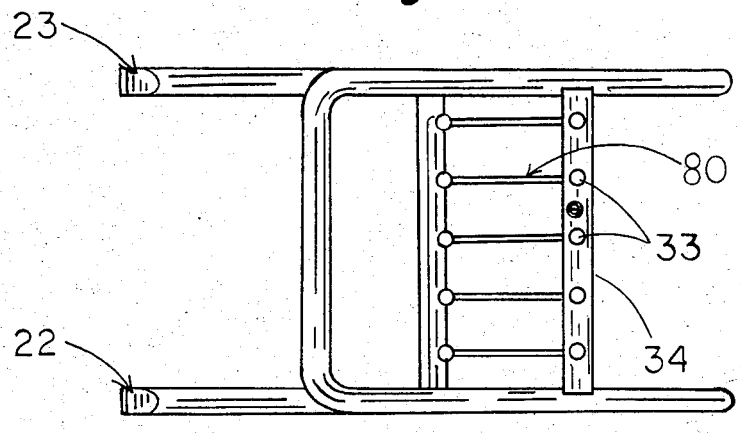
FIG. 12 is a top plan view of the rack taken along the lines 12—12 in FIG. 10.
Figure 10:
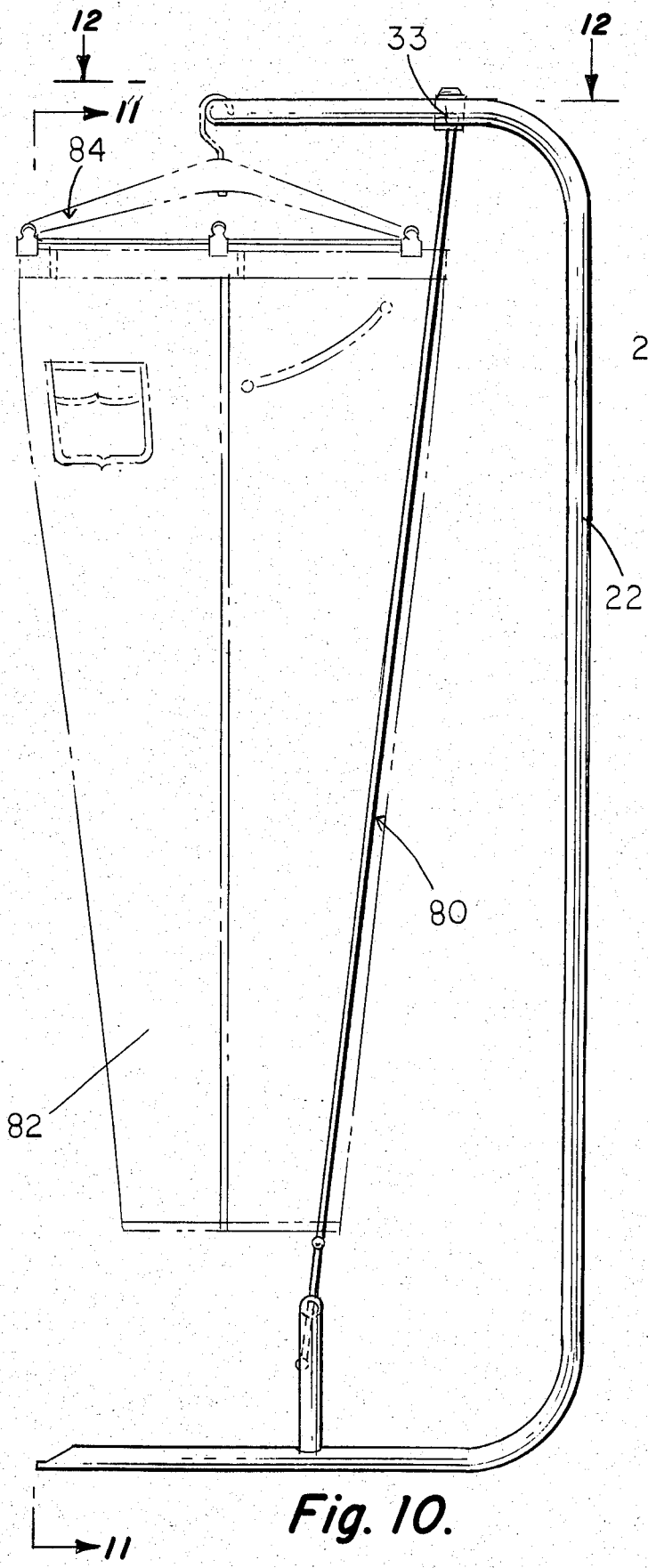
FIG. 10 is a side elevational view of a clothing rack for retaining a pair of trousers.

FIGS. 10, 11, and 12 disclose a second embodiment of the invention, which finds use for providing a security lock for trousers. There is disclosed a first and second upright arms 22 and 23 forming the frame means. The locking means 34 is attached between the two upright arms 22 and 23. The locking means is disclosed in FIGS. 3 through 8, and the discussion regarding these drawings applies to the locking means in this embodiment.

The securing means 40 is the same as that disclosed in FIG. 9. Accordingly, all previous discussions regarding FIG. 9 apply to this embodiment.

The rod 80 functions in the same manner as the hanger 26 does. It is passed through one leg of a pair of trousers 82 shown in phantom lines in FIG. 10. A clothing hanger 84 is also shown in phantom lines in FIG. 10, for supporting the trousers in a hanging fashion to preserve a neat appearance. The rod 80 has one end secured to the brace 40 to allow for a limited reciprocal movement of the rod 80. The other end of the rod 80 has an enlargement 33 for removable attachment to the locking means 34. The sales clerk simply unlocks the lock 48 with a key, opens up the hinged cover, slides the head 33 through the slot 54, lowers the rod 80 away from the channel section 36, and removes the trousers 82. The trousers can be re-secured to the garment lock by a reversal of these steps.

It is contemplated by the inventor the frame means not be free standing units as disclosed in the Figs. In clothing and department stores, it is common to have cubicles against the wall. In this case, the frame means could be the panels of the cubicles. The securing means and the locking means would be securely attached between the panels.

Whereas the present invention has been shown and described herein in what is conceived to be the best mode contemplate it is recognized that departures may be made thereform within the scope of the invention which is therefore not to be limited to the details disclosed herein but is to be afforded the full scope of the invention.

What is claimed is:

1. A clothing rack comprising:

frame means comprising a first upright arm and a second upright arm;

at least one rod removably attached near one end to said frame means for retaining an article of clothing on said frame means;

locking means for locking said rod to said frame means, said locking means comprising:

a channel section having an edge and a web and connected between said first and second arms;

a hinged cover pivotally attached to said edge of said channel section;

at least one tapered opening in said web of said channel section for receiving said one end of said rod;

at least one stop means attached to said hinged cover for preventing the disengagement of said end of said rod with said channel section whenever said hinged cover is closed;

securing means for attaching the other end of said rod to said frame means and preventing separation of said rod from said frame means, said securing means being an elongate brace and extending between said arms.

2. The rack as recited in claim 1 wherein said one end of said rod being attached to said channel section includes:

an extension having an enlargement at one end.

3. The rack as recited in claim 2 further comprising:

a lock having a cam means for preventing the opening of said hinged cover whenever said lock is locked.

4. The rack as recited in claim 2 wherein said stop means comprises:

at least one bar adjacent to each of said rod enlargement and being attached to the underside of said hinged cover so that when said cover is closed said bar extends through said web and prevents said rod enlargment from disengaging from said channel section.

5. The rack as recited in claim 1 wherein:

said tapered opening includes a key-hole shaped slot.

6. A clothing rack comprising:

frame means comprising a first upright arm and a second upright arm;

at least one rod removably attached near one end to said frame means for retaining an article of clothing on said frame means;

locking means for locking said rod to said frame means, said locking means comprising:

a channel section having an edge and a web and connected between said first and second arms;

a hinged cover pivotally attached to said edge of said channel section;

at least one tapered opening in said web of said channel section for receiving said one end of said rod;

at least one stop means attached to said hinged cover for preventing the disengagement of said end of said rod with said channel section whenever said hinged cover is closed;

securing means for attaching the other end of said rod to said frame means and preventing separation of said rod from said frame means, said securing means being an elongate brace and extending between said arms;

said securing means further having a hole in said brace for allowing the end of said rod to be slideably engaged in said hole;

first stay means secured at the bottom of said rod for preventing detachment of said rod from said brace, and for preventing the removal of the garment secured by said rod; and second stay means secured to said rod inward of said brace for restricting the reciprocal movement of said rod within said hole of said brace.

7. A clothing rack comprising:

frame means having a first upright arm and a second upright arm;

a plurality of rods each one removably attached near one end of said frame means for retaining an article of clothing on said frame means, said rods being in a generally vertical orientation;

locking means for locking said rods to said frame means having a channel means positioned horizontally above and transverse to said rods;

said locking means comprising a channel section having an edge and a web and connected between said first and second arms;

a hinged cover pivotally attached to said edge of said channel section;

at least one tapered opening in said web of said channel section for receiving said one end of each said rod;

at least one stop means attached to said hinged cover for preventing the disengagement of said end of each said rod with said channel section whenever said hinged cover is closed;

securing means for attaching the other end of each said rod to said frame means and preventing separation of each said rod from said frame means, said securing means being an elongate brace and extending between said arms.

8. The rack as recited in claim 7 wherein said one end of said rod being attached to said channel section includes:

an extension having an enlargement at one end.

9. The rack as recited in claim 8 further comprising a lock having a cam means for preventing the opening of said hinged cover whenever said lock is locked.

10. The rack as recited in claim 7 wherein said stop means comprises:

at least one bar adjacent to each of said rod enlargement and being attached to the underside of said hinged cover so that when said cover is closed said bar extends through said web and prevents said rod enlargement from disengaging from said channel section.

11. The rack as recited in claim 7 wherein:

said tapered opening includes a key-hole shaped slot.

12. A clothing rack comprising:

a frame means;

a plurality of rods each one removably attached near one end to said frame means for retaining an article of clothing on said frame means, said rods being in a generally vertical orientation.

locking means for locking said rods to said frame means having a channel means positioned horizontally above and transverse to said rods;

said locking means comprising a channel section having an edge and a web and connected between said first and second arms;

a hinged cover pivotally attahced to said edge of said channel section;

at least one tapered opening in said web of said channel section for receiving said one end of each said rod;

at least one stop means attahced to said hinged cover for preventing the disengagement of said end of said rod with said channel section whenever said hinged cover is closed;

securing means for attaching the other end of each said rod to said frame means and preventing separation of each said rod from said frame means, said securing means being an elongate brace and extending between said arms, said securing means having a hole in said brace for allowing the end of said rod to be slideably engaged in said hole;

first stay means secured at the bottom of said rod for preventing detachment of said rod from said brace, thereby preventing the removal of the garment secured by said rod;

second stay means secured to said rod inward of said brace for restricting the reciprocal movement of said rod within said hole for said brace.

13. A clothing rack comprising:

frame means;

a plurality of hangers, each one removably attached near one end to said frame means for retaining an article of clothing on said frame means, said hangers being in a generally vertical orientation;

locking means for locking said hangers to said frame means, said locking means further comprising a channel means positioned horizontally above and transverse to said hangers;

securing means for attaching the other end of each said hanger to said frame means and preventing separation of each said hanger from said frame means;

each of said hangers further comprising a bent rod having a horizontal section, a downwardly extending section at one end of said horizontal section, and an upright section extending from said horizontal section having an enlargement for slideably fitting with said locking means.

14. The rack as recited in claim 13 wherein:

said enlargement includes a head such as a ball, hook, knob, button, or a washer.

15. A rack as recited in claim 13 wherein said frame means comprises:

a first upright arm and a second upright arm, said securing means being an elongate brace and extending between said arms.

16. A rack as recited in claim 15 wherein said locking means comprises:

a channel section having an edge and a web and connected between said first and second arms;

a hinged cover pivotally attached to said edge of said channel section;

at least one tapered opening in said web of said channel section for receiving said upright section of said hanger;

at least one stop means attached to said hinged cover for preventing the disengagement of said upright section of each said hanger with said channel section whenever said hinged cover is closed.

17. The rack as recited in claim 16 further comprising:

a lock having a cam means for preventing the opening of said hinged cover whenever said lock is locked.

18. The rack as recited in claim 13 wherein said securing means comprises:

a brace;

a hole in said brace for allowing said upright section of said hanger to be slideably engaged in said hole;

first stay means secured at the bottom of said vertical section of said hanger for preventing detachment of said hanger from said brace, thereby preventing the removal of the garment secured by said hanger.

19. The rack as recited in claim 18 further comprising:

second stay means secured to said vertical section inward of said brace for restricting the reciprocal movement of said hanger within said hole of said brace.

20. The rack as recited in claim 13 wherein each said hanger is comprised of:

five-sixteenth inch rolled steel.

* * * * *